US007391992B2

(12) United States Patent
Inoue

(10) Patent No.: US 7,391,992 B2
(45) Date of Patent: Jun. 24, 2008

(54) SHEET CONVEYING UNIT, AND IMAGE READING UNIT, POST-PROCESSING UNIT, AND IMAGE FORMING APPARATUS EMPLOYING THE SHEET CONVEYING UNIT

(75) Inventor: Nobuo Inoue, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 281 days.

(21) Appl. No.: 10/942,781

(22) Filed: Sep. 17, 2004

(65) Prior Publication Data

US 2005/0058479 A1 Mar. 17, 2005

(30) Foreign Application Priority Data

Sep. 17, 2003 (JP) ..... 2003-324062
Jan. 6, 2004 (JP) ..... 2004-000798

(51) Int. Cl.
*G03G 21/00* (2006.01)
*B41J 29/17* (2006.01)

(52) U.S. Cl. ..... 399/123; 399/34; 101/423

(58) Field of Classification Search ..... 399/390, 399/389; 271/183
See application file for complete search history.

(56) References Cited

U.S. PATENT DOCUMENTS 4,878,657 A * 11/1989 Ura et al. ..... 271/9.13
5,014,090 A * 5/1991 Santilli ..... 399/233
5,611,529 A * 3/1997 Richarz et al. ..... 271/183
5,671,476 A * 9/1997 Ishiguro et al. ..... 399/354
5,673,911 A * 10/1997 Loftus et al. ..... 271/273
5,974,290 A 10/1999 Inoue
5,984,305 A 11/1999 Inoue
6,145,825 A * 11/2000 Kunihiro et al. ..... 270/58.09
6,507,719 B2 * 1/2003 Furuya ..... 399/128
6,577,827 B2 * 6/2003 Matsuura et al. ..... 399/45
6,663,099 B2 12/2003 Inoue
6,701,108 B2 * 3/2004 Mizuno et al. ..... 399/130
6,792,232 B2 * 9/2004 Suzuki et al. ..... 399/175
2002/0163120 A1 * 11/2002 Yamada et al. ..... 271/221
2003/0039495 A1 * 2/2003 Takami et al. ..... 399/357
2003/0202830 A1 * 10/2003 Oh et al. ..... 399/390
2005/0201790 A1 * 9/2005 Inoue ..... 399/390

FOREIGN PATENT DOCUMENTS

JP 59113472 A * 6/1984
JP 01184177 A * 7/1989
JP 01286879 A * 11/1989
JP 7-215523 8/1995
JP 10111630 * 4/1998
JP 2000-227728 * 8/2000

* cited by examiner

*Primary Examiner*—Daniel J. Colilla
*Assistant Examiner*—'Wynn' Q Ha
(74) *Attorney, Agent, or Firm*—Oblon, Spivak, McClelland, Maier & Neustadt, P.C.

(57) ABSTRACT

A sheet conveying unit that guides and conveys a sheet material by a lower conveying guide includes an opening in the lower conveying guide, a brush-like member on a downstream side of the opening to scrap off paper dust adhered on a surface of a sheet material. A sheet detecting unit controls operation of the brush-like member.

9 Claims, 5 Drawing Sheets

SHEET CONVEYING UNIT, AND IMAGE READING UNIT, POST-PROCESSING UNIT, AND IMAGE FORMING APPARATUS EMPLOYING THE SHEET CONVEYING UNIT

CROSS-REFERENCE TO RELATED APPLICATIONS

The present document incorporates by reference the entire contents of Japanese priority documents, 2003-324062 filed in Japan on Sep. 17, 2003 and 2004-000798 filed in Japan on Jan. 6, 2004.

BACKGROUND OF THE INVENTION

1) Field of the Invention

The present invention relates to a sheet conveying unit that conveys a sheet of recording medium in an image reading unit, a post-processing unit, and an image forming apparatus.

2) Description of the Related Art

In an image forming apparatus such as a copying machine, for example, a sheet material is placed on a sheet conveying guide, the material is conveyed while being guided by the sheet conveying guide, a toner image formed, for example by an image forming unit, is transferred on the sheet material to form an image on the sheet material, and the sheet material with the formed image is discharged to the image forming apparatus main unit to be stacked on, for example, a tray.

Recently, however, for the purpose of resource saving or cost reduction, recycled paper or the back side of used paper is frequently utilized. When an image forming apparatus is used for such recycled sheets of paper over a long period of time, it often results in deposition of paper dust generated in the course of conveyance of sheet materials on a sheet conveying guide.

Particularly, when the sheet conveying guide is provided with a curved portion, since a sheet material hits the sheet conveying guide at the curved portion, or it is bent or rubbed by the curved portion, paper dust adhered to an end surface (a cut edge face) or a surface of the sheet material drops and deposits, particularly on the curved portion or the like.

When paper dust is deposited on the sheet conveying guide as described, the paper dust adheres to another sheet in conveyance again, so that a frictional coefficient of a conveying roller is lowered and a deviation occurs in conveyance of the sheet material.

When deposited paper dust adheres to a sheet material in conveyance again to enter in an image preparing unit, for example, in an electrostatic photography type image forming apparatus, there is a problem of occurrence of such an abnormal image that, when paper dust adheres on an image carrier and the adhered paper dust cannot be completely removed by a cleaning unit, black or white stripes or black or white spots appear on a formed image.

Therefore, a technique for forming a hole for paper dust drop in a sheet conveying guide to allow paper dust to drop from the hole has been proposed (see, for example, Japanese Patent Application Laid-open No. H7-215523).

In the technique, paper dust on a sheet dropping from the hole in the course of conveyance can be removed, however, paper dust which do not drop from the sheet and remains in adhesion thereon cannot be removed and it may drop or deposit in the course of following conveyance of the sheet, which results in contamination inside the image forming apparatus, which further causes lowering of a conveying performance due to skew or increase in slippage rate. In this image forming apparatus, there is such a drawback that the remaining paper dust adheres on an image carrier, or that black or white stripes or black or white spots appear on the image, if the remaining paper dust cannot be completely removed by a cleaning unit.

SUMMARY OF THE INVENTION

It is an object of the present invention to solve at least the above problems in the conventional technology.

A sheet conveying unit according to one aspect of the present invention includes a lower conveying guide that guides a sheet material, with an opening, and a brush-like member that is provided on a downstream side of the opening.

An image forming apparatus according to another aspect of the present invention includes a sheet conveying unit that includes a lower conveying guide that guides a sheet material, with an opening, and a brush-like member that is provided on a downstream side of the opening.

An image reading unit according to still another aspect of the present invention includes a sheet conveying unit that includes a lower conveying guide that guides a sheet material, with an opening, and a brush-like member that is provided on a downstream side of the opening.

A post-processing unit according to still another aspect of the present invention includes a sheet conveying unit that includes a lower conveying guide that guides a sheet material, with an opening, and a brush-like member that is provided on a downstream side of the opening.

The other objects, features, and advantages of the present invention are specifically set forth in or will become apparent from the following detailed description of the invention when read in conjunction with the accompanying drawings.

DETAILED DESCRIPTION OF THE PREFERRED EMBODIMENTS

Exemplary embodiments of a sheet conveying unit, and an image reading unit, a post-processing unit, and an image forming apparatus employing the sheet conveying unit according to the present invention will be explained in detail with reference to the accompanying drawings.

Figure 1:
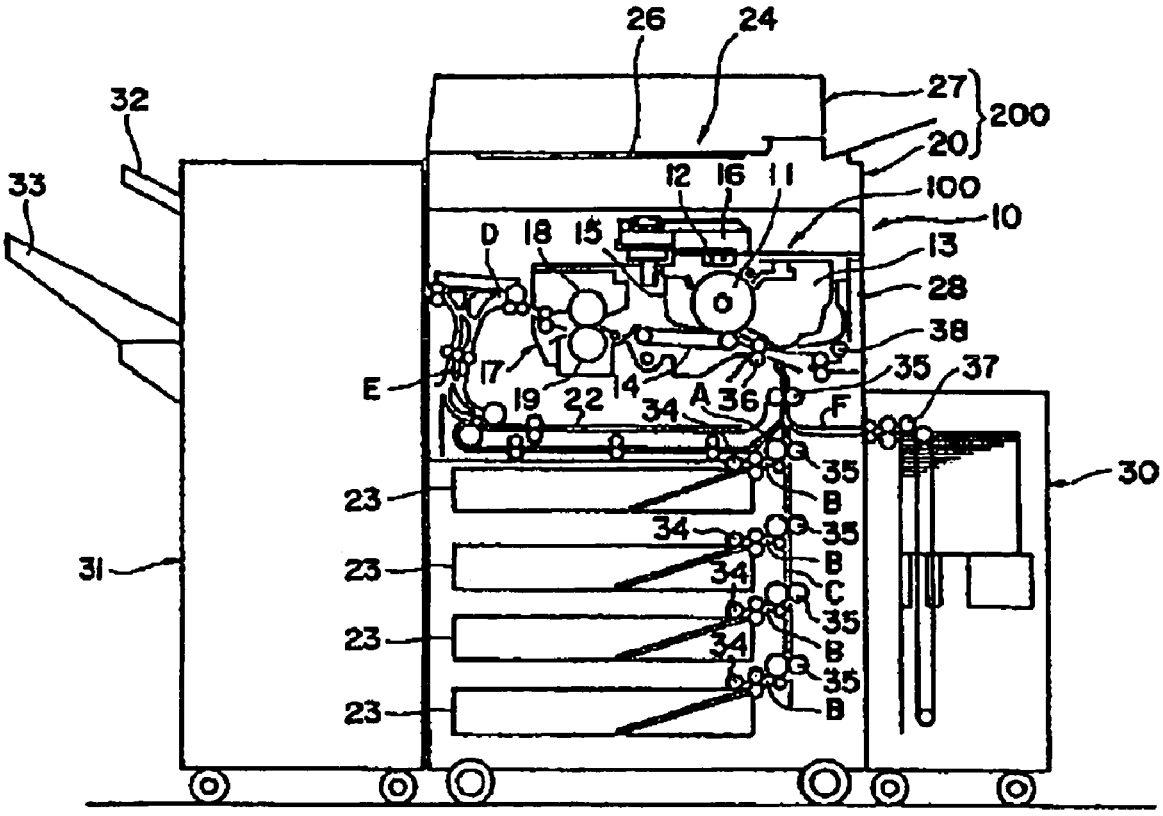
FIG. 1 is a schematic of a laser copying machine that employs a sheet conveying unit according to the present invention.

FIG. 1 is a schematic of a laser copying machine that employs a sheet conveying unit according to the present invention. Reference number 10 denotes a main unit of the laser copying machine (hereinafter, "an apparatus main unit"). An image forming device 100 is provided in the apparatus main unit 10. The image forming device 100 is provided with a drum-like image carrier (a photoconductor) 11 and is also provided around the image carrier with a charging device 12, a developing device 13, a transferring/conveying device 14, a cleaning device 15, and the like.

The image forming device 100 includes a laser writing device 16. Though not shown, the laser writing device 16 includes a light source such as a laser diode, a scanning rotary multi-facet mirror which is a polygon mirror, a polygon motor, a scanning optical system such as an fθ lens or a mirror, and the like. A fusing device 17 is provided on the left side of the cleaning device 15 in FIG. 1. The fusing device 17 includes a fuser roller 18 with a built-in heater and a pressure roller 19 pushing the fuser roller 18 upwardly.

An optical reader 20 is provided in an upper portion of the apparatus main unit 10. Though not shown, the optical reader 20 includes a light source, a plurality of mirrors, an image forming lens, an image sensor such as a charge coupled device (CCD), and the like. On the other hand, a duplexing unit 22 and four-tier paper feed cassettes 23 are provided along a vertical direction in a lower portion of the apparatus main unit 10. Each paper feed cassette 23 receives sheet materials such as a paper or an overhead projector (OHP) transparency. Such configuration is employed that the duplexing unit 22 communicates with a common paper feeding path C extending from the image carrier 11 downwardly through a sheet re-feeding path A and the paper feed cassette 23 communicates therewith through a feeding path B. A reversing path E branched from a middle portion of a sheet discharging path D extending from an outlet of the fusing device 17 is formed toward the duplexing unit 22.

A contact glass 26 is disposed in an image reading unit 24 on an upper surface of the apparatus main unit 10. An automatic document feeder (ADF) 27 is provided on the apparatus main unit 10 so as to allow opening/closing operations and cover the contact glass 26. The ADF 27 and the optical reader 20 constitute an image reading device 200.

A manual feed tray 28 that guides a manually fed sheet material to a paper feeding path C is provided on a right side of the apparatus main unit 10 so as to allow opening/closing operations. A large capacity paper feeding apparatus 30 is externally provided on the outer side of the apparatus main unit 10, where a large capacity of sheet material is placed so as to allow an up-and-down stacking.

On the other hand, a sheet post-processing apparatus 31 externally added on the outside of the apparatus main unit 10 is provided on the left side of the apparatus main unit 10. The sheet post-processing apparatus 31 receives sheet materials discharged through the sheet discharging path D to discharge them on the upper tier fixed tray 32 as they are or to discharge them on the upper tier fixed tray 32 or a lower-tier movable tray 33 after the sheet materials are subjected to post-processing such as a stapling or punching operation.

When copying is performed by the copying machine, an original document is set on the ADF 27, or the ADF 27 is opened and an original document is directly set on the contact glass 26. When a document is set on the ADF 27, the document conveyed to the contact glass 26 of the image reading unit 24 by the ADF 27 driven by operating a start switch (not shown) is read for each pixel by the optical reader 20 of the image reading device 200. Alternatively, when a document is set on the contact glass 26 in advance, the set document is read for each pixel by the optical reader 20 of the image reading device 200.

Simultaneously, a paper feed roller 34 selected is rotated to feed a sheet material from a corresponding paper feed cassette 23 of the plurality of paper feed cassettes 23 provided in the apparatus main unit 10 in a multiple-tier configuration, and the sheet material is conveyed to the paper feeding path C by a conveying roller pair(s) 35 through the paper feeding path B to be caused to hit a registration roller pair 36 for stopping. The registration roller pair 36 is rotated timely with rotation of the image carrier 11 to feed the sheet material below the image carrier 11 of the image forming device 100.

Alternatively, a paper feed roller 37 is rotated to feed a sheet material from the large capacity paper feeding apparatus 30, and the sheet material is conveyed to the paper feeding path C by the conveying roller pair 35 through the conveying path F to be caused to hit the registration roller pair 36 for stopping. Also alternatively, a paper feed roller 38 positioned at the manual feed unit is rotated to feed a manually fed sheet material set on the manual feed tray 28 opened to the paper feeding path C to be caused to hit the registration roller pair 36 for stopping. The registration roller pair 36 is rotated timely with rotation of the image carrier 11 to feed the sheet material below the image carrier 11 of the image forming device 100.

On the other hand, when a start switch (not shown) is pressed, the image carrier 11 in the image forming device 100 is simultaneously rotated in a clockwise direction on FIG. 1. A surface of the image carrier 11 is first charged by the charging device 12 uniformly according to the rotation of the image carrier 11, laser beam is then irradiated on the charged surface corresponding to content of the document read by the optical reader 20 to perform writing with the laser writing device 16, an electrostatic latent image is formed on the surface of the image carrier 11, and toner is thereafter adhered to the latent image by the developing device 13 to visualize the electrostatic latent image.

As described above, the visualized image is transferred on the sheet material fed below the image carrier 11 by the transferring/conveying device 14. The image carrier 11 after the image thereon is transferred is cleaned by the cleaning device 15 such that the residual toner is removed thereon, thereby providing for the following similar image formation.

On the other hand, the sheet material with the transferred image is conveyed to the fusing device 17 by the transferring/conveying device 14, where the transferred image is fused on the sheet material with heat and pressure of a fuser roller 18 and a pressure roller 19. Thereafter, the sheet material is discharged to the sheet post-processing apparatus 31 through the sheet discharging path D.

When images are formed on both surfaces of a sheet material, the sheet material enters the reversing path E from a position midway of the sheet discharging path D, and is reversed by the duplexing unit 22 to be entered in the paper feeding path C again through the sheet re-feeding path A. The sheet material is again fed to the image forming device 100 where an image formed on the image carrier 11 separately is transferred on a back surface of the sheet material by the transferring/conveying device 14, and after the transferred image on the back surface is fused in the fusing device 17, the sheet material is discharged to the sheet post-processing apparatus 31.

Figure 2:
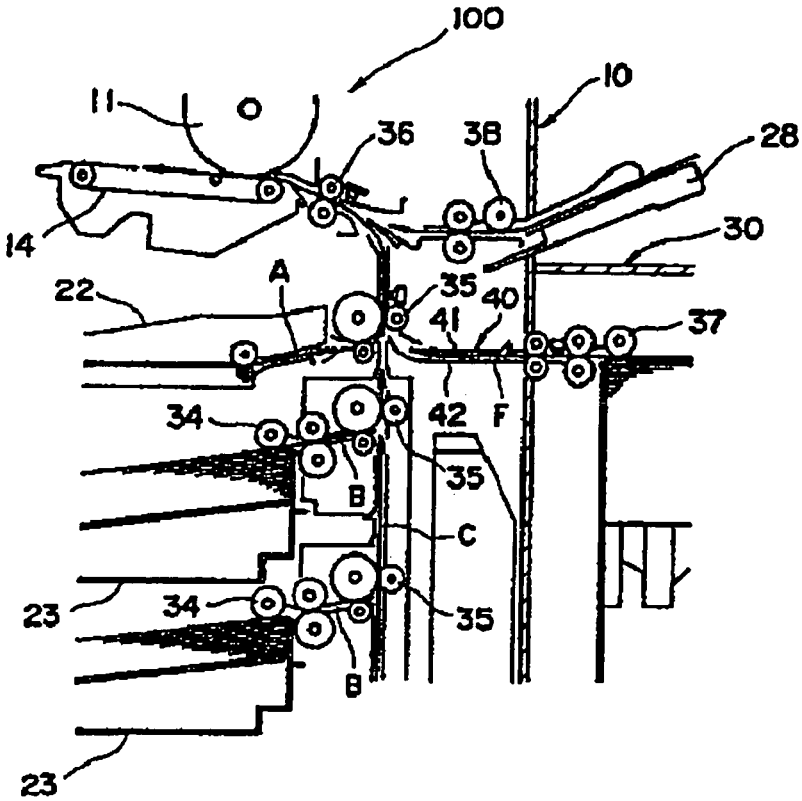
FIG. 2 is an enlarged view of an upstream side of an image forming unit in a sheet conveying direction in the laser copying machine shown in FIG. 1.

A portion in the laser copying machine shown in FIG. 1, which is positioned upstream of the image forming device 100 in a sheet conveying direction, is shown in FIG. 2 in an enlarged manner.

As shown in FIG. 2, for example, in a sheet conveying unit 40 that guides a sheet material from the large capacity paper feeding apparatus 30 to the paper feeding path C, an upper conveying guide 41 and a lower conveying guide 42 constitute the conveying path F. The upper and lower conveying guides 41 and 42 are, for example, provided in the apparatus main unit 10 so as to be opposed to each other, and both sides thereof are supported by side plates supporting the image carrier 11, the charging device 12, the developing device 13, the cleaning device 15, and the like.

As described above, at a time of image forming, for example, the paper feed roller 37 is rotated to feed a sheet material out of the large capacity paper feeding apparatus 30, the fed sheet material is put on the lower conveying guide 42 and conveyed through the conveying path F while being guided by the upper and lower conveying guides 41 and 42, and the sheet material is entered in the paper feeding path C to be further conveyed by the conveying roller 35. In addition, since the sheet re-feeding path A from the duplexing unit 22 also joins at a position at which the conveying path F joins the paper feeding path C, the number of sheet materials passing through the position becomes very large.

Since the conveying path F is sharply curved just before the position, a sheet material hits the lower conveying guide 42 to be bent or rubbed thereby, so that dropping of paper dust from the sheet material is likely at the position. Dropped paper dust eventually deposits on the lower conveying guide 42.

Figure 3A:
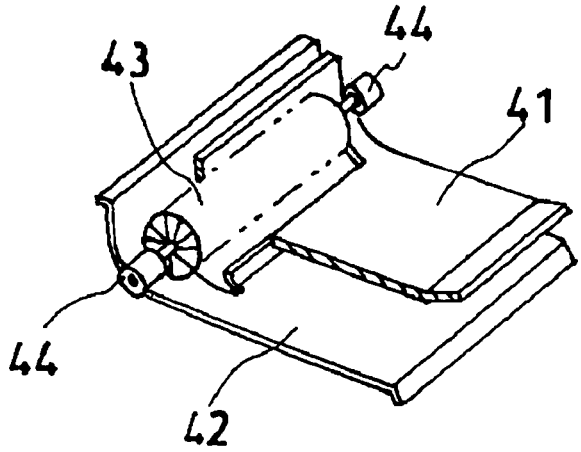
FIG. 3A is a perspective view of a conveying guide of the sheet conveying unit provided in the laser copying machine shown in FIG. 1.
Figure 3B:
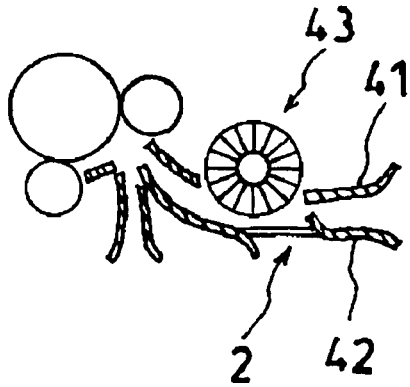
FIG. 3B is a cross section of the conveying guide except for a paper dust collector.

In view of these circumstances, the apparatus main unit 10 shown in FIG. 1 includes the sheet conveying unit 40 shown in FIGS. 3A and 3B in order to prevent such paper dust from depositing on the lower conveying guide 42. As shown in FIGS. 3A and 3B, in the sheet conveying unit 40 that guides a sheet material P fed from the large capacity paper feeding apparatus 30 to the paper feeding path C, the upper conveying guide 41 and the lower conveying guide 42 constitute the conveying path F. The upper and lower conveying guides 41 and 42 are provided in the apparatus main unit 10, and both sides thereof are supported by side plates (not shown).

An opening 2 is provided in a direction orthogonal to the sheet conveying direction at a slightly upstream portion of the curved portion of the lower conveying guide 42. The upper conveying guide 41 is also provided with a similar opening, and a brush-like member 43 extends from the opening 2 toward the lower conveying guide 42 and is retained by a retaining member 44 which is then fixed on the upper conveying guide 41.

At this time, the brush-like member 43 is set such that the relationship between the minimum sheet propelling force Fp generated when a sheet material P is conveyed by a pair of rollers to contact on the brush-like member 43 and the maximum conveying resistance force Rb which is applied to the sheet material by the brush-like member 43 always meets Fp>Rb. A configuration is employed such that paper dust adhered to sheet materials P is scraped off by the brush-like member 43 each time when each sheet material P passes through the sheet conveying path F.

Figure 4A:
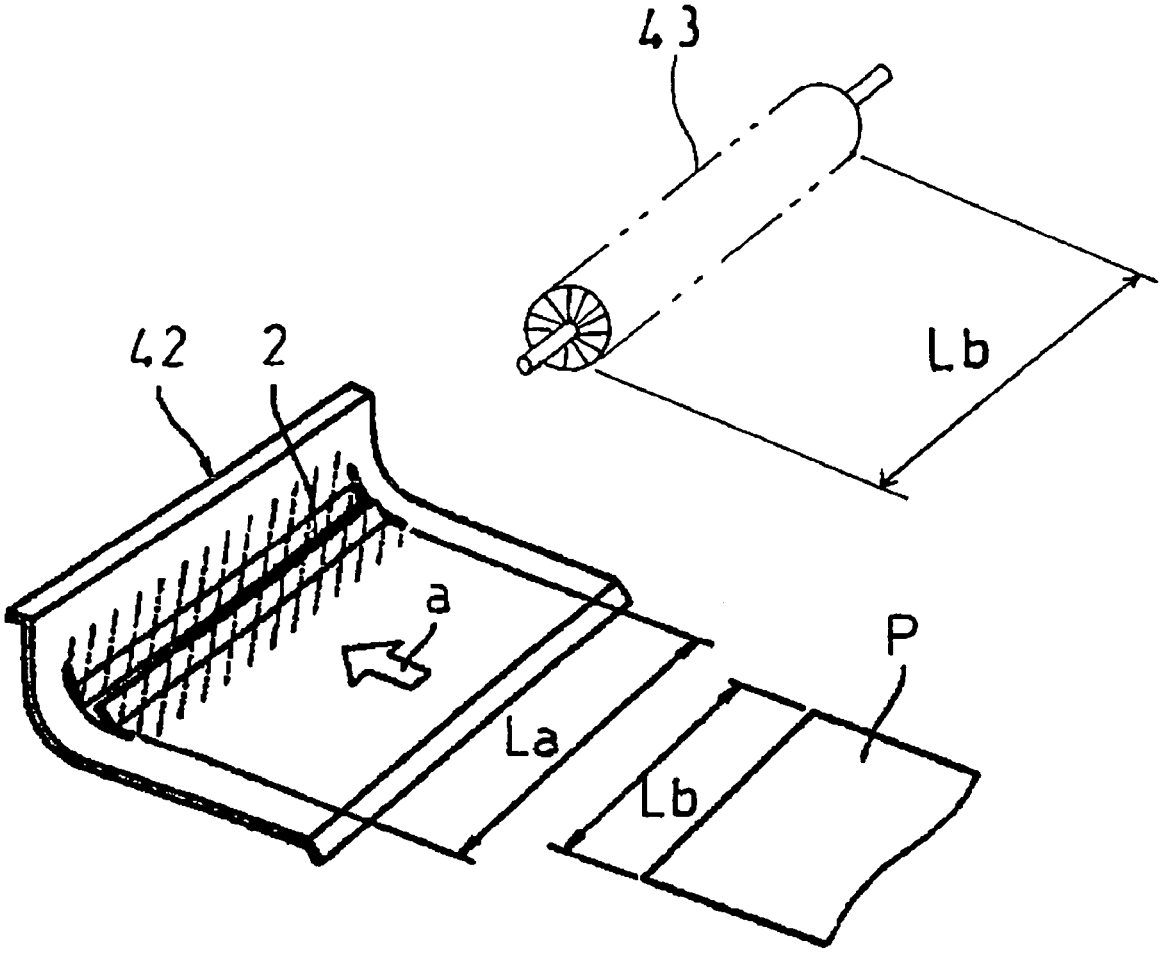
FIG. 4A is an exploded perspective view of the conveying guide of the sheet conveying unit provided in the laser copying machine shown in FIG. 1.
Figure 4B:
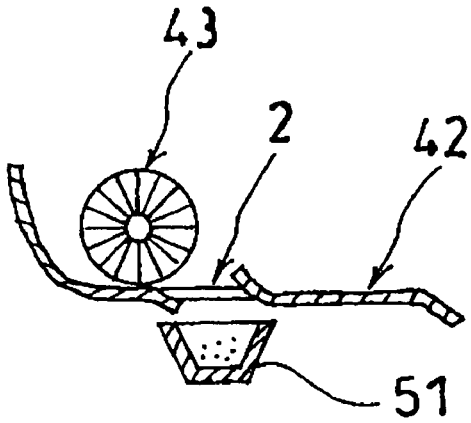
FIG. 4B is a cross section of the conveying guide.

A configuration is employed such that a distal end of the brush-like member 43 projects so as to contact with a conveying surface of the lower conveying guide 42 and it necessarily comes in contact with a sheet material P being conveying. As shown in FIGS. 4A and 4B, a size La, in a widthwise direction, of the opening 2 of the lower conveying guide 42 provided in the direction orthogonal to the sheet conveying direction and a width Lb of the brush-like member 43 are set to be sufficiently larger than a maximum sheet width Lp which allows sheet conveyance (La>Lp, Lb>Lp). That is, paper dust on a cut portion of a sheet from which paper dust is most easily generated can be scraped off.

The quality of material for the brush-like member 43 retained by the retaining member 44 is constituted of electrically conductive material, material which is subjected to charging-preventing process or a charging-preventing material (not shown). When the brush-like member is constituted from electrically conductive material, the retaining member 44 is also made from an electrically conductive material.

As shown in FIG. 4B, a paper dust collector 51 that collects dropping paper dust or the like is provided below the opening 2 of the lower conveying guide 42. The paper dust collector 51 is constituted to be easily drawn alone from the apparatus main unit so as to easily clear the waste such as collected paper dust (not shown).

Figure 5:
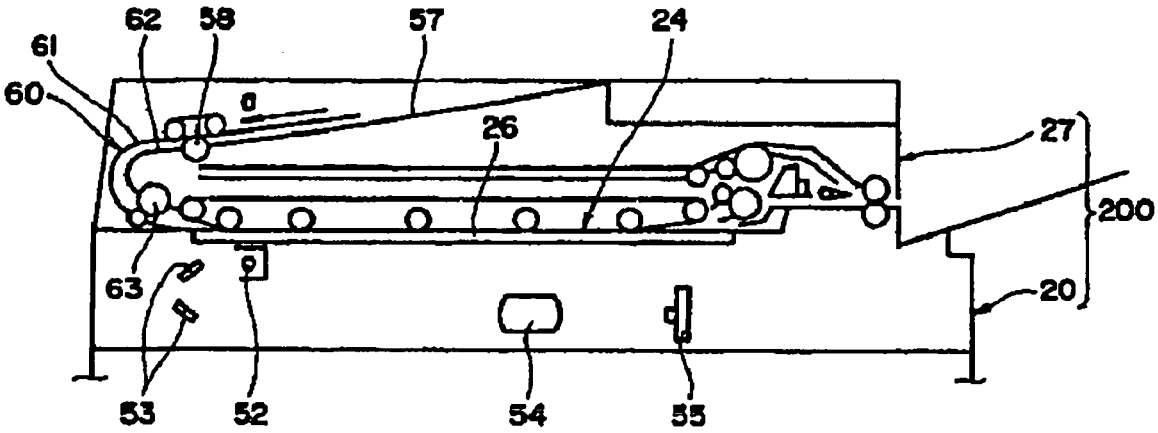
FIG. 5 is an enlarged view of an image reading unit provided in the laser copying machine shown in FIG. 1.

FIG. 5 is an enlarged view of an image reading unit 200 provided in the laser copying machine shown in FIG. 1. As described above, the image reading device 200 is constituted of the optical reader 20 and the ADF 27.

The optical reader 20 includes a light source 52, a plurality of mirrors 53, an imaging lens 54, an image sensor 55 such as CCD, and the like. The contact glass 26 is provided on the image reading unit 24 positioned on an upper surface of the optical reading unit 20.

On the other hand, the ADF 27 is provided with a document set table 57 on which sheet documents (sheet materials) are set from the above, a paper feed roller 58 that feeds the sheet documents one by one, and a sheet conveying unit 60 that reverses the fed document to convey the same to the image reading unit 24. The sheet conveying unit 60 is constituted of a pair of sheet guides 61 and 62 and a pair of conveying rollers 63, and is provided at an upstream position of the image reading unit 24 in a sheet conveying direction "a".

At an image reading time, the paper feed roller 58 is rotated to feed the sheet documents set on the document set table 57 one by one and convey the sheet document to the image reading unit 24 by the conveying roller 63 While guiding the same by the sheet guides 61 and 62, thereby setting them on the contact glass 26. The light source 52 is then moved along the contact glass 26, and light from the light source 52 is sequentially irradiated on a document surface to reflect a reflected light from the document surface on the mirror 53 while moving the mirror 53. The reflected light from the mirror 53 is imaged by the imaging lens 54 and light signal is converted to electric signal by the image sensor 55 to read image information or data on the document surface.

In the image reading device 200 shown in FIG. 5, one of lower conveying guides 61 positioned on a lower side, when a document is reversed, is the sheet conveying guide according to the present invention. Though not shown, the lower conveying guide 61 is also provided with the opening 2 and the like, for example, like the lower conveying guide 42 shown in FIG. 3.

Figure 6:
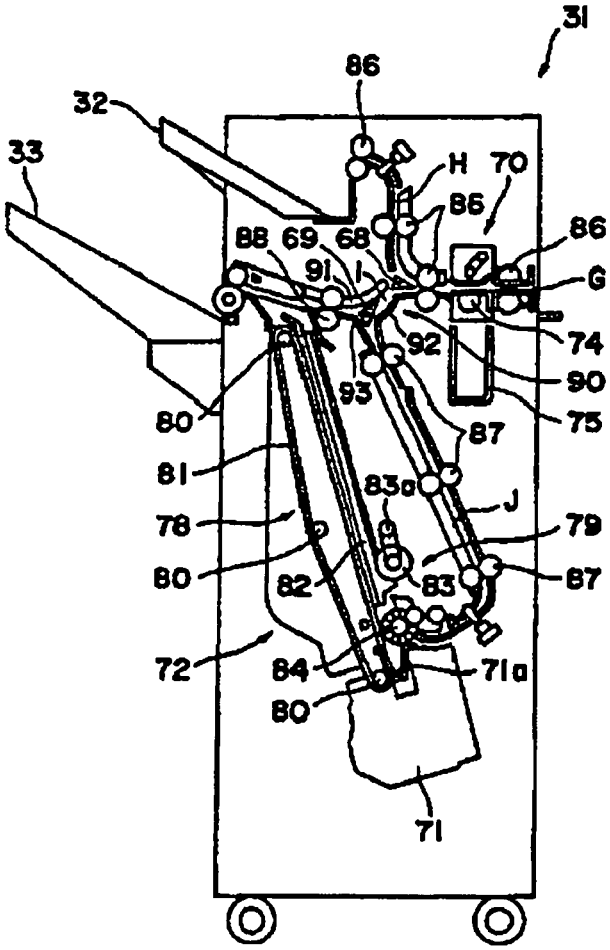
FIG. 6 is an enlarged view of a post-processing unit provided in the laser copying machine shown in FIG. 1.

FIG. 6 is an enlarged view of a post-processing unit 31 provided in the laser copying machine shown in FIG. 1. The post-processing apparatus 31 is provided with a post-processing conveying path G continuous from the sheet discharging path D of the apparatus main unit 10 shown in FIG. 1. The post-processing apparatus 31 is also provided with a post-processing discharging path H continuous from a position of a tray branching projection 68 of the post-processing conveying path G toward the fixed tray 32 and a post-processing discharging path I extending toward the movable tray 33.

Further, the post-processing apparatus 31 is provided with a staple conveying path J branched from a position of a staple branching projection 69 provided at a midway of the post-processing discharging path I to join the post-processing discharging path I again. The post-processing apparatus 31 includes a sheet conveying unit 90 downstream of the position of the tray branching projection 68. The sheet conveying unit 90 is constituted of an upper sheet guide 91, lower sheet guides 92 and 93, a pair of conveying rollers 88, and the staple branching projection 69.

Such a post-processing apparatus 31 includes a punching device 70, a stapling device 71, an intermediate tray 72, and the like in addition to the fixed tray 32, and the movable tray 33 described above. The punching device 70 includes a punching roller 74 having a pin (not shown), a dust collector 75, and the like. The stapling device 71 includes a stapler (not shown) that staples sheet materials and the like. The intermediate tray 72 includes a conveying device 78, an aligning device 79, and the like.

The conveying device 78 is provided with, for example, three rollers 80, where a belt 81 is entrained about the three rollers. A sheet material is temporarily held at an intermediate tray position 82 on the belt 81. The aligning device 79 includes a nudger roll 83 that performs alignment of a sheet material held at the intermediate tray position 82 in the sheet conveying direction and in a direction perpendicular to the sheet conveying direction. The aligning device 79 also includes aligning roller 84 that performs alignment of the sheet material in the sheet conveying direction, a vertical direction aligning device (not shown) that performs alignment of the sheet material in the direction perpendicular to the sheet material conveying direction, and the like.

In the post-processing apparatus 31, when post-processing is not performed, the tray branching projection 68 is pivoted to one of the fixed tray 32 and the movable tray 33, and the staple branching projection 69 is pivoted to the movable tray 33 side. Thereafter, the sheet material with the formed image which is sent from the sheet discharging path D of the apparatus main unit 10 is entered in the post-processing conveying path G and the sheet material is conveyed by the conveying roller 86, so that the sheet material is discharged into the fixed tray 32 or the movable tray 33.

When post-processing in the form of punching is performed, the tray branching projection 68 is pivoted to the side of one of the fixed tray 32 and the movable tray 33, and the staple branching projection 69 is pivoted to the side of the movable tray 33.

Thereafter, the sheet material with the formed image which is sent from the sheet discharging path D of the copying machine main unit 10 is entered in the post-processing conveying path G and the punching roller 74 is rotated timely with conveyance of the sheet material, so that the sheet material is punched by the pin of the punching roller 74. The punched sheet material is conveyed by the conveying roller 86 and discharged onto the fixed tray 32 or the movable tray 33.

On the other hand, dust due to punching is collected in the dust collector 75 disposed below the punching roller 74.

When a post-processing for stapling is performed, the tray branching projection 68 is pivoted to the side of the movable tray 33 and the staple branching projection 69 is pivoted to the side of the stapling unit 71.

Thereafter, the sheet material with the formed image which is sent from the sheet discharging path D of the copying machine main unit 10 is entered in the post-processing conveying path G and the sheet material is conveyed to the staple conveying path J by the conveying roller 86 while being guided by the upper and lower sheet guides 91, 92, and 93. Thereafter, the sheet material is further conveyed by the staple conveying roller 87 and is temporarily held at the intermediate tray position 82.

Simultaneously, the aligning unit 79 is actuated to rotate the aligning roller 84 in a counterclockwise direction, the sheet material at the intermediate tray position 82 is pushed on a sheet conveying direction reference position 71*a*, thereby performing alignment in the sheet conveying direction. Simultaneously, the vertical direction aligning unit is also actuated to perform alignment in the direction orthogonal to the sheet conveying direction. Simultaneously therewith, the nudger roll 83 is repeatedly rotated about a shaft 83*a* to nudge the sheet material at the intermediate tray position 82, thereby performing alignment in the sheet conveying direction/the direction orthogonal to the sheet conveying direction.

Similarly, a predetermined number of sheet materials are held at the intermediate tray position 82. Thereafter, after the aligning unit 79 is stopped, the stapler of the stapling unit 71 is actuated to perform stapling on the sheet materials at the intermediate tray position 82.

One driving roller of the three rollers 80 in the conveying unit 78 is then rotationally driven and the remaining two idle rollers are dependently rotated, thereby rotating the belt 81 in the counterclockwise direction on FIG. 6. The sheet materials held at the intermediate tray position 82 is discharged onto the movable tray 33 according to rotation of the belt 81.

Finally, the movable tray 33 is moved downwardly corresponding to the discharged sheet materials for receiving sheet materials to be discharged next.

In the post-processing unit 31 shown in FIG. 6, one lower sheet guide 92 which is positioned at the lower side when a sheet material is entered in the post-processing discharging path I is the sheet conveying guide described as the invention. Though not shown, the lower sheet guide 92 also includes an opening 2 and a paper dust removing unit 45 like the lower sheet guide 42 shown in FIG. 3.

Figure 7A:
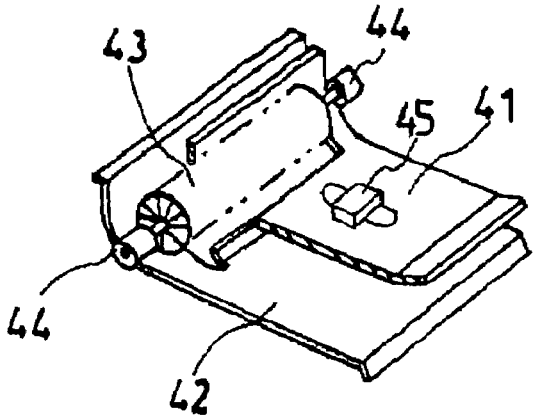
FIG. 7A is a perspective view of a conveying guide of a sheet conveying unit according to a second embodiment of the present invention.
Figure 7B:
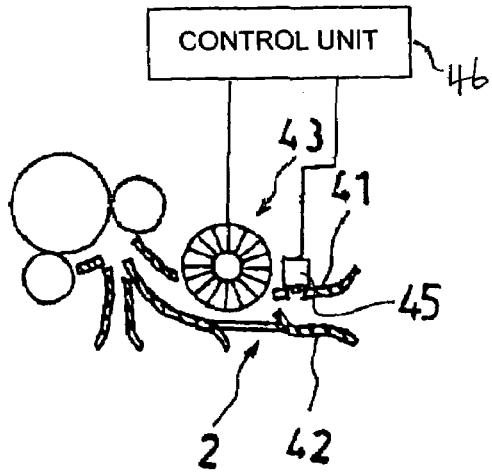
FIG. 7B is a cross section of the conveying guide of the sheet conveying unit according to the second embodiment except for a paper dust receptor.

In the following explanation, portions or parts with the same functions and advantage as described above are designated by like reference signs, and detailed explanations thereof are omitted. Differences from the first embodiment will be mainly explained below. In a second embodiment of the present invention, as shown in FIG. 7, a sheet detector 45 is provided upstream of the brush-like member 43, and rotation of the brush-like member 43 is controlled by a controller 46 based upon detection information obtained by the sheet detector 45. The brush-like member 43 can be rotated forward and backward and stopped by a driving unit.

More specifically, when a sheet material is conveyed by roller pairs and a distal end thereof is detected by the sheet detector 45, rotation of the brush-like member 43 is controlled just before the distal end of the sheet material contacts on the brush-like member 43 (reduction in revolution speed, rotation stoppage, forward rotation, and the like). The brush-like member 43 is set such that a relationship between a sheet propelling force Fp of a sheet material and a conveying resistance force Rb applied to the sheet material always meets Fp>Rb. A configuration is employed such that, after a distal end of a sheet material passes through the brush-like member 43, the brush-like member 43 is rotated backward against an advancing direction of the sheet material to be brought into contact with the sheet material and paper dust adhered on a surface of the sheet material is scraped off positively.

While the present invention is not limited to the embodiments, it can be modified variously without departing from the scope of the invention. The image forming apparatus is not limited to such a copying machine described above, and it may be a printer, a facsimile machine, or the like.

According to the first aspect of the invention, since a surface of a sheet material guided by the lower conveying guide is rubbed by the brush-like member, it is made possible to scrape off paper dust adhered to a surface of a sheet material effectively, so that image quality or conveying performance in the image forming apparatus can be maintained over a long period of time.

According to the second aspect of the invention, an advantage similar to the first aspect can be achieved, and image quality or conveying performance in the image forming apparatus can be maintained further efficiently, because the brush-like member is in contact with a conveying surface of the lower conveying guide, a sheet material can be conveyed in a sandwiching manner between the brush-like member and the conveying surface of the lower conveying guide.

According to the third aspect of the invention, advantages similar to the first or the second aspect can be achieved, and paper dust can be scraped off from various sheet materials conveying on the lower conveying guide, because the width of the opening and the width of the brush-like member are set to be larger than a maximum width of sheet materials conveyed on the lower conveying guide.

According to the fourth aspect of the invention, an advantage similar to that in any one of the first to the third aspects can be achieved, and electrostatic electricity generated on a surface of a sheet material during conveyance of the sheet material can be removed, conveying performance of the sheet material or image quality in a post step can be kept well, and paper dust adhered on the sheet material can be securely scraped off, because the brush-like member is made of electrically conductive material.

According to the fifth aspect of the invention, an advantage similar to any of the first to the third aspects can be achieved, and paper dust scraped off can be prevented from adhering to the brush-like member again, because the brush-like member is subjected to charging-preventing processing.

According to the sixth aspect of the invention, an advantage similar to any of the first to the fifth aspects can be achieved, and paper dust scraped off by the brush-like member can be collected in the paper dust collector and paper dust can be prevented from remaining inside the sheet conveying unit, because the paper dust collector that collects paper dust is provided on the lower conveying guide.

According to the seventh aspect of the invention, an advantage similar to any of the first to the sixth aspects can be achieved, and conveyance inferiority of a sheet material can be prevented by rotation of the brush-like member suitable for each sheet material, because rotation of the brush-like member can be controlled based upon detection information obtained by the sheet detector provided upstream of the opening.

According to the eighth aspect of the invention, an image forming apparatus having each advantage described in any one of the first to the seventh aspects can be provided.

According to the ninth aspect of the invention, an image reading device having each advantage described in any one of the first to the seventh aspects can be provided.

According to the tenth aspect of the invention, a post-processing apparatus having each advantage described in any one of the first to the seventh aspects can be provided.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A sheet conveying unit comprising:

a lower conveying guide that guides a sheet material upwardly along a curved portion of said lower conveying guide, said lower conveying guide including an opening;

a brush-like member for removing paper dust, wherein said brush-like member is provided on a downstream side of the opening and on an upstream side of the curved portion, and a sheet detecting unit provided on an upstream side of the opening, wherein rotation of the brush-like member is controlled based on detection information obtained by the sheet detecting unit.

2. The sheet conveying unit according to claim 1, wherein the brush-like member is in contact with a conveying surface of said lower conveying guide.

3. The sheet conveying unit according to claim 1, wherein the opening is formed in a direction normal to a conveying direction of the sheet material, and a width of the opening and a width of the brush-like member are set to be larger than a maximum width of the sheet material to be conveyed.

4. The sheet conveying unit according to claim 1, wherein the brush-like member is electrically conductive.

5. The sheet conveying unit according to claim 1, wherein the brush-like member comprises a charge-preventing member or is made of a charge-preventing material.

6. The sheet conveying unit according to claim 1, wherein said lower conveying guide includes a paper dust collector that collects paper dust which has dropped through the opening.

7. A sheet conveying unit comprising:

a lower conveying guide that guides a sheet material upwardly along a curved portion of said lower conveying guide, said lower conveying guide including an opening spaced from the curved portion of said lower conveying guide;

a brush-like member located above said upper conveying guide for removing paper dust and discharging the paper dust through the opening in said lower conveying guide, wherein said brush-like member is provided on a downstream side of the opening and on an upstream side of the curved portion; and a sheet detecting unit located in proximity with the opening of said lower conveying guide, wherein rotation of said brush-like member is controlled based on detection of information obtained by said sheet detection unit.

8. A sheet conveying unit comprising:

a lower conveying guide that guides a sheet material upwardly along a curved portion of said lower conveying guide, said lower conveying guide including an opening spaced from the curved portion of said lower conveying guide;

a brush-like member located above said upper conveying guide for removing paper dust and discharging the paper dust through the opening in said lower conveying guide, wherein said brush-like member is provided on a downstream side of the opening and on an upstream side of said curved portion of said lower conveying guide; and a sheet detecting unit located in proximity with the opening of said lower conveying guide, wherein rotation of said brush-like member is controlled based on detection of information obtained by said sheet detection unit.eb; normal

9. A sheet conveying unit that includes a lower conveying guide that guides a sheet material upwardly along a curved portion of said lower conveying guide, said lower conveying guide including an opening spaced from the curved portion of said lower conveying guide;

a brush-like member located above said upper conveying guide for removing paper dust and discharging the paper dust through the opening in said lower conveying guide, wherein said brush-like member is provided on a downstream side of the opening and on an upstream side of the curved portion; and a sheet detecting unit located in proximity with the opening of said lower conveying guide, wherein rotation of said brush-like member is controlled based on detection of information obtained by said sheet detection unit.

* * * * *